US005320216A

United States Patent [19]

Pangborn

[11] Patent Number: 5,320,216

[45] Date of Patent: Jun. 14, 1994

[54] CAN CARRIER

[76] Inventor: Dominic Pangborn, 917 Lakeshore, Grosse Pointe Shores, Mich. 48236

[21] Appl. No.: 66,714

[22] Filed: May 24, 1993

Related U.S. Application Data

[63] Continuation-in-part of Ser. No. 944,313, Sep. 11, 1992.

[51] Int. Cl.[5] ..... B65D 75/00

[52] U.S. Cl. ..... 206/158; 206/148; 206/153; 206/429

[58] Field of Search ..... 206/147, 148, 149, 153, 206/158, 194, 199, 427, 429, 434

[56] References Cited

U.S. PATENT DOCUMENTS

| | | | |
|---|---|---|---|
| 2,844,245 | 7/1958 | Gruber et al. . | |
| 3,001,647 | 9/1961 | Liss | 206/427 |
| 3,038,600 | 6/1962 | Powell | 206/158 |
| 3,139,981 | 7/1964 | Akeireb | 206/158 |
| 3,404,912 | 10/1968 | Watts . | |
| 3,612,266 | 10/1971 | Graser . | |
| 3,653,503 | 4/1972 | Arneson | 206/153 |
| 3,661,417 | 5/1972 | Inman . | |
| 3,764,001 | 10/1973 | Graser . | |
| 4,190,149 | 2/1980 | Oliff et al. . | |
| 4,453,630 | 6/1984 | Helms et al. . | |
| 4,621,734 | 11/1986 | Heijnen et al. . | |
| 5,103,971 | 4/1992 | Schuster . | |
| 5,135,104 | 8/1992 | Jorba | 206/427 |
| 5,188,225 | 2/1993 | Jorba | 206/158 |
| 5,201,412 | 4/1993 | Schuster et al. | 206/153 |

FOREIGN PATENT DOCUMENTS

| | | |
|---|---|---|
| 2098585 | 10/1972 | France . |

*Primary Examiner*—David T. Fidei

*Attorney, Agent, or Firm*—Harness, Dickey & Pierce

[57] ABSTRACT

A device for securing a plurality of cans having a plurality of apertures and a plurality of slits defining a plurality of tabs surrounding each aperture which engage the upper rims of cans to secure the cans when the upper rims thereof are inserted through the apertures.

9 Claims, 3 Drawing Sheets

CAN CARRIER

CROSS REFERENCE TO RELATED APPLICATIONS

This application is a continuation-in-part of U.S. Ser. No. 07/944,313, filed Sept. 11, 1992, entitled "Can Carrier".

BACKGROUND OF THE INVENTION

The present invention relates to packaging of cans. More specifically, the present invention relates to a device which utilizes a planar surface made of a rigid, foldable material with a plurality of apertures for engaging the upper periphery of a plurality of cans.

Objects of this invention are to provide a device for securing a plurality of cans which is safe for the environment reusable and inexpensive. Further objects of the present invention include providing a can securing device which, when securing a plurality of cans, may be stacked upon other such devices securing cans; which provides a sanitary protective cover over the lids of the cans; which provides surfaces which may be used as an advertising medium and which may be used as a tray to carry opened cans when the device is inverted.

U.S. Pat. No. 3,085,683 which issued Apr. 16, 1963 to J. W. Harrison shows a prior art device for carrying cans. However that device requires the expensive use of a heatshrinkable plastic film which is not biodegradable. That device is not reusable, nor can a plurality of those devices be stacked upon one another while holding cans.

Another device for carrying cans is shown in U.S. Pat. No. 4,911,288 issued on Mar. 27, 1990 to Kenneth R. Dantoin, Jr. However that device does not secure the cans about the upper periphery as does the present invention which provides for easy removal of the can, easy reuse of the device, and the ability to use the device as a tray for the cans when the device is inverted.

A more commonly used device for securing a plurality of cans consists essentially of a piece of thick plastic, usually polyethylene, adapted to fit tightly around the upper portion of a plurality of cans, usually six or eight. The friction between the plastic and the cans prevents the cans from slipping out of the device, thus enabling the plurality of cans to be handled as one unit.

Use of these plastic devices has become environmentally disfavored as they are not biodegradable, nor can they be recycled economically. They have also been found to be a hazard to wildlife such as fish and fowl. When these devices are improperly disposed of, animals have been found to suffocate by becoming entangled in them or by partially swallowing them.

Furthermore, it is impractical to reuse these plastic devices to secure cans after use since the plastic becomes deformed by removal of the can, and because of the tight fitting nature of the device. Besides not being reusable, these devices have a relatively high material cost and provide no space which could be utilized as a means for advertising.

Another drawback to the use of these plastic devices is that the top of the can is left uncovered. Most beverage cans are opened by pressing a tab portion of the lid into the can. This tab portion of the lid is at least partially submerged into the contents of the can, and because it is left uncovered prior to opening the can, it may introduce undesirable contaminants into the contents. Accordingly, there is a need for an inexpensive device for securing a plurality of cans that is not harmful to the environment, is reusable, stackable, provides space for advertising and the like, may be used as a tray when inverted, and is sanitary. The present invention is directed to that end.

SUMMARY OF THE INVENTION

The present invention resides in a thin device, made of a relatively rigid, yet flexible material capable of securing cans about their upper periphery. It is also contemplated that the present invention would be adapted to secure other types of containers such as bottles and the like.

The bottom surface of the device has a plurality of apertures matching the number of cans to be secured. The diameter of the apertures is less than the diameter of the upper rim of the cans. About the circumference of the apertures are a plurality of tabs created by slits in the bottom surface extending radially from each aperture. It is also contemplated that the slits about the apertures may be made in a circumferential direction.

The purpose of the invention, securing a plurality of cans, is accomplished by inserting the upper periphery of the cans into the bottom surface of the device through the apertures, thus pushing the tabs upward. The cans have rims circumscribing the tops thereof, and once the rims are pushed up past the tabs, the tabs engage the rims and exert enough upward force thereon to support the cans. The cans are also thereby prevented from any lateral movement.

The device may also have a top surface with side surfaces transverse to the top and bottom surfaces. The top surface of the device may have a pair of finger holes for the purpose of grasping the device and thus handling the plurality of cans secured by the device. Furthermore, the top and the sides of the device may be utilized as billboards for advertising and the like.

Additional objects, advantages and features of the present invention will become apparent from the following description and appended claims, taken in conjunction with the accompanying drawings.

DETAILED DESCRIPTION OF THE PREFERRED EMBODIMENT

Figure 1:
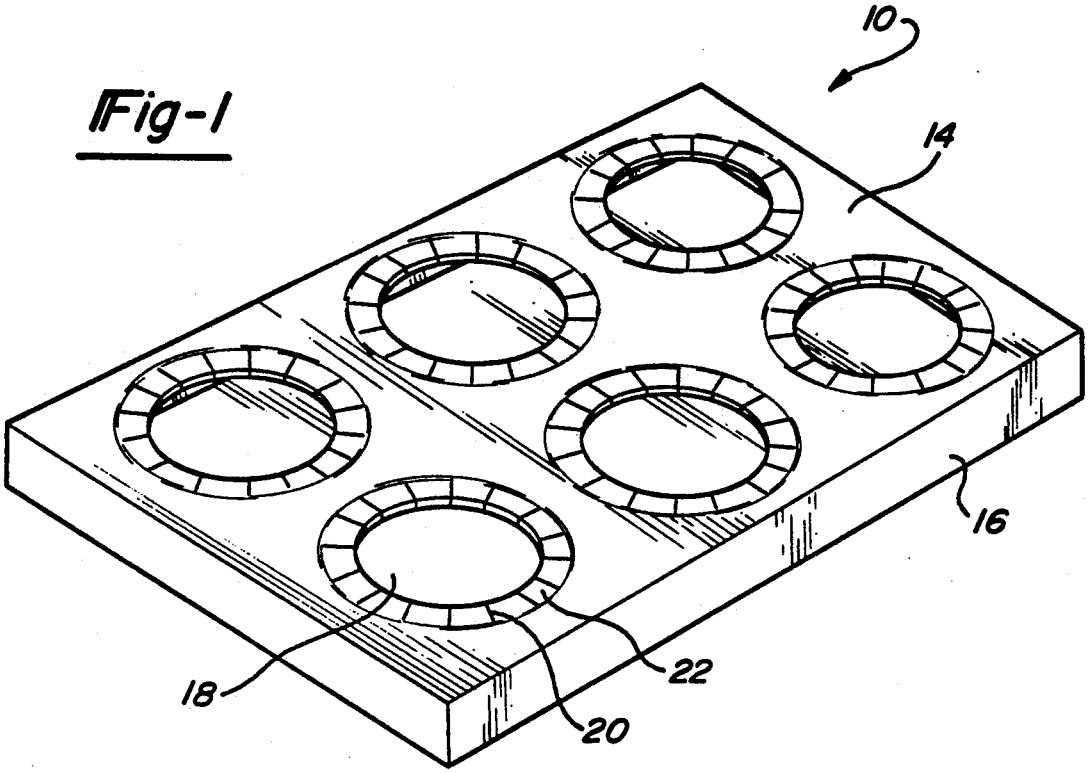
FIG. 1 is a perspective view illustrating the bottom and side portions of the present invention.

Referring now to the drawings, FIG. 1 shows a cardboard device 10 for securing a plurality of cans. It is also contemplated that the device 10 may be constructed of materials other than cardboard that are relatively rigid, yet flexible. The device 10 is preferably, but not necessarily, polyhedral shaped. The bottom planar member 14 of the device 10 is rectangular and has six apertures 18 therethrough. It is also contemplated that the device may have fewer than or greater than six apertures. Around each aperture 18 in the bottom planar member 14 is a plurality of slits 20 cut in the cardboard and extending radially from the aperture 18. The slits 20 create a plurality of radial tabs 22 circumscribing the apertures 18. The slits 20 are of a length such that the distance from the radially outward end of the slit 20 to the center of the aperture 18 is substantially similar to the radius of the upper rim of a can to be secured. In an alternate embodiment, the slits 20 are of a length such that the distance from the radially outward end of the slit 20 to the center of the aperture 18 is slightly greater than the radius of the upper rim of a can to be secured. Thus the radially outward ends of the tabs 22 define imaginary circles concentric to the apertures 18 and having a diameter substantially similar to or slightly greater than that of the upper rim of the can to be secured.

Figure 2:
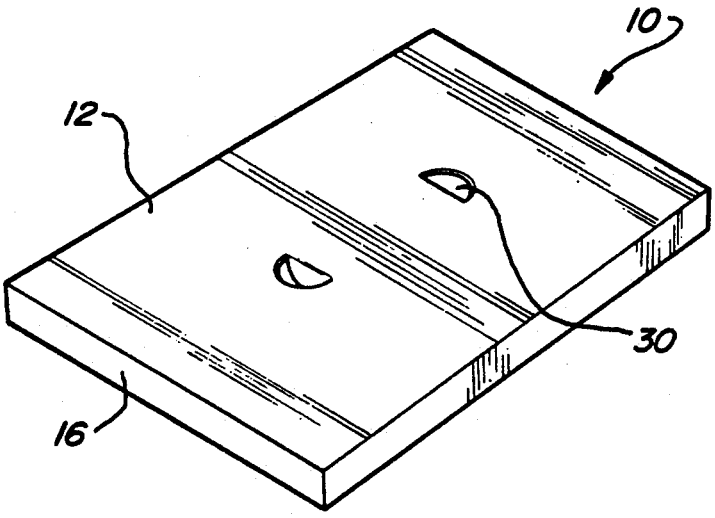
FIG. 2 is a perspective view illustrating the top and side portions of the present invention.

FIG. 2 shows a perspective view of the top 12 of the device 10. The top member 12 is rectangular, of substantially the same dimensions as the bottom member 14, and is parallel to the bottom member 14. There are two finger holes 30 in the top 12 of the device 10 for grasping the device 10. The finger holes 30 are equidistant from the center of the top member 12 and are located along a line which is central to the top member 12 and parallel to the two longer edges of the rectangular top member 12.

Figure 3:
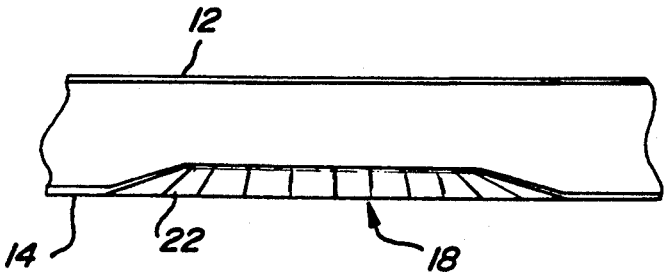
FIG. 3 is a fragmentary cross section view of an aperture of the present invention.
Figure 4:
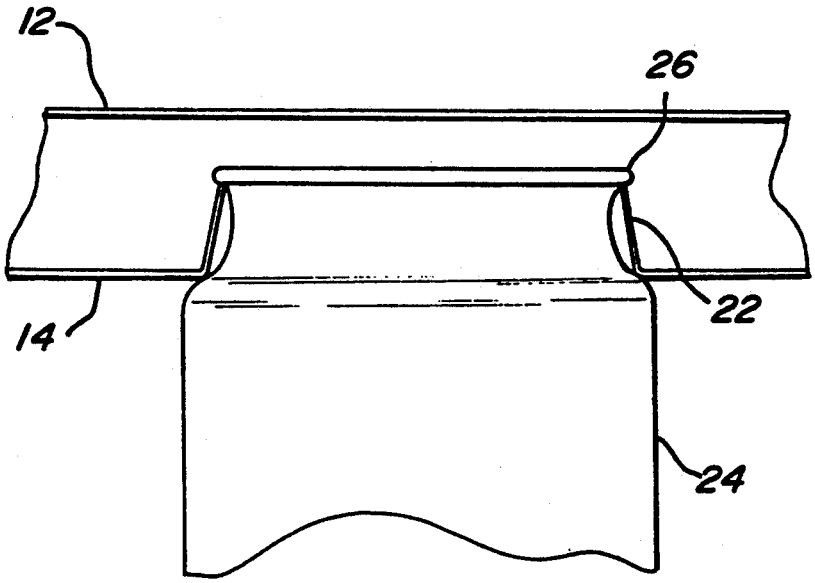
FIG. 4 is a fragmentary cross sectional view of an aperture of the present invention showing the tabs engaging a can.
Figure 5:
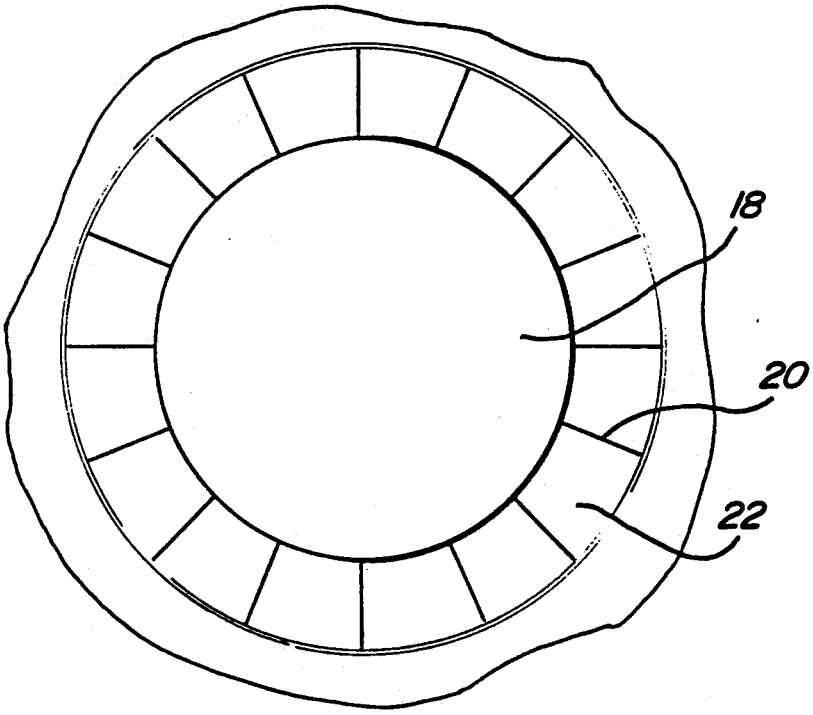
FIG. 5 is a fragmentary view of an aperture of the present invention.

The device 10 is utilized by inserting the upper peripheries of cans through the apertures 18. In FIG. 3, aperture 18 is shown with the tabs 22 in an initial horizontal position. In FIG. 4, the upper periphery of a can 24 is inserted through the aperture 18, thus forcing the tabs 22 upward. The can 24 is inserted to a point where the rim 26 of the can 24 is above the tabs 22. The tabs 22 engage the rim 26 circumscribing the upper periphery of the can 24. In this position, the tabs 22 can exert enough upward force on the rim 26 to support the can 24. By securing a can 24 in each of the apertures 18, a plurality of cans 24 are secured.

The cans 24 are removed from the device 10 by exerting a downward force on the cans 24, thus forcing the tabs 22 downward to disengage the rims 26. When the cans 24 are removed, the tabs 22 return to their original horizontal position as seen in FIG. 3. The device 10 may thereafter be reused.

The side members 16 and top member 12 give rigidity to the device 10 while also enabling a plurality of such devices 10 containing cans 24 to be stacked upon one another. Furthermore, the side members 16 and top planar member 12 may be designed to provide advertising and the like. As seen in FIG. 4, the top member 12 also provides a protective cover for the can 24, thus preventing contaminants from settling on the top of the can 24 prior to removal of the can 24 from the device 10. Once the cans 24 are removed, the device 10 may be inverted to an upside down position to be used as a tray wherein the bottom peripheries of the cans are inserted into the apertures 18.

Figure 6:
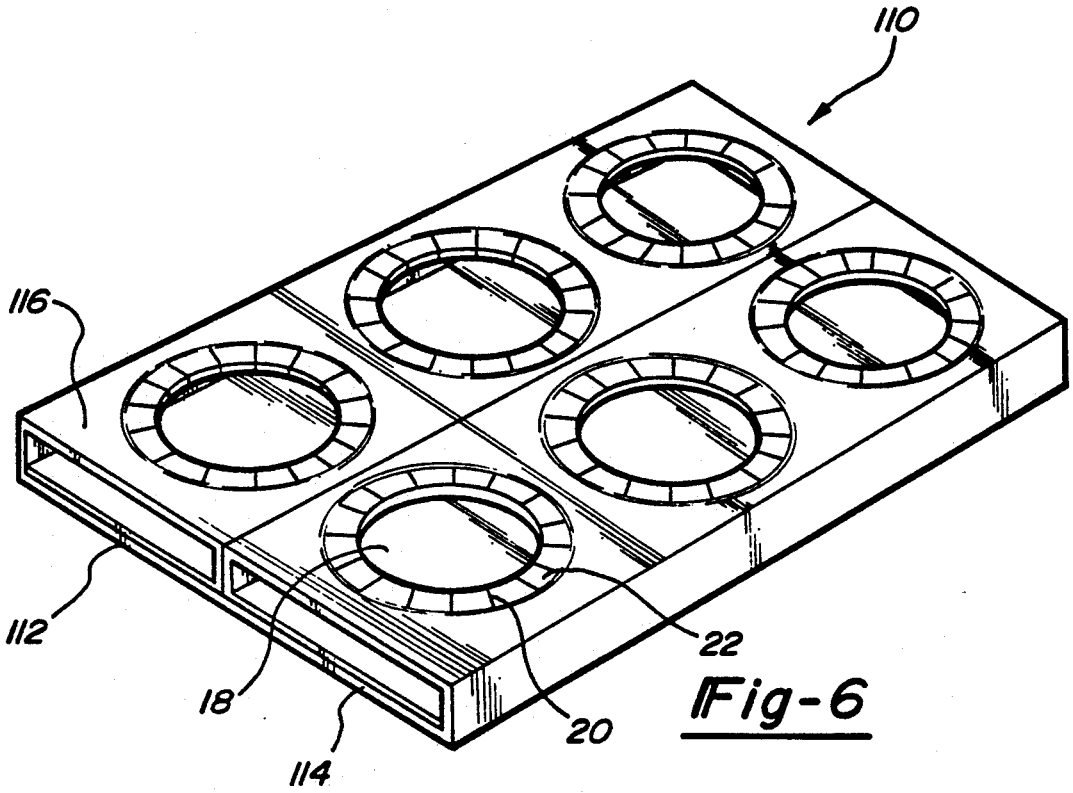
FIG. 6 is a perspective view similar to that of FIG. 1 illustrating the bottom and side portion of another embodiment of the present invention.
Figure 7:
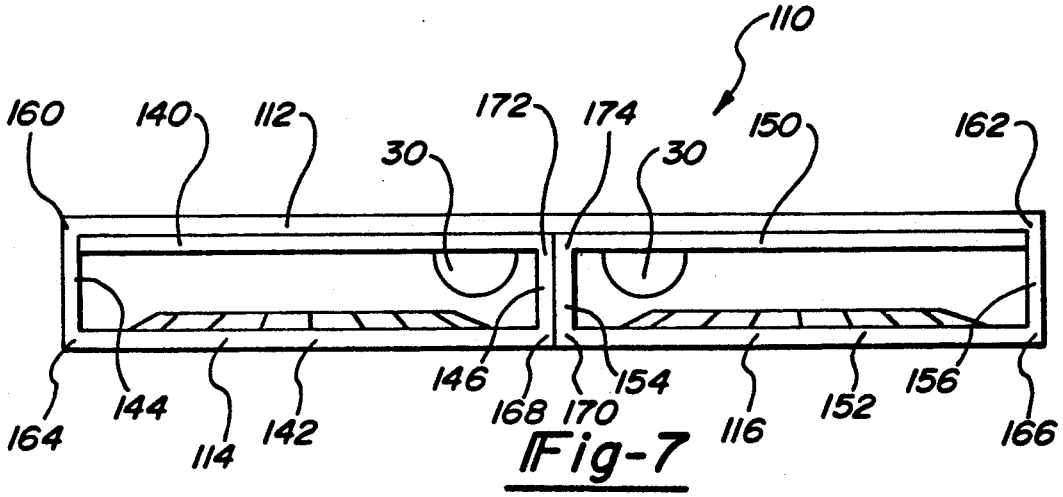
FIG. 7 is an end view of the embodiment of FIG. 6 illustrating the folding of a single sheet of material.

FIGS. 6 and 7 show another embodiment of the device of the present invention which is generally designated by the reference numeral 110. Device 110 provides additional supporting structure in order to lesson the chances of gapping or bowing of the top panel with respect to the bottom panel when device 110 is being used to support the larger sized cans.

Device 110 comprises an upper planar member 112, a first generally rectangular box section 114 and a second generally rectangular box section 116. Upper planar member 112 is rectangular, similar to top member 12 shown in FIG. 2 except for the location of the two finger holes 30. Finger holes 30 in the embodiment shown in FIGS. 1 through 5 are equidistant from the center of the top member and are located along a line which is central to top member 12 and parallel to the two longer edges of top member 12. Upper flange member 112 also has two finger holes 30 which are equidistant from the center of the top member. Finger holes 30 in upper planar member 112 are not along the line central to upper planar member but are offset an equal distance on opposite sides of the central line in order to avoid interference with the added support structure as shown in FIG. 7.

First generally rectangular box section 114 includes an upper panel 140, a lower panel 142, a first side panel 144 and a second side panel 146. Lower panel 142 is rectangular approximately one-half the size of upper planar member 112 and has three apertures 18 therethrough. While the present invention is shown as having three apertures 18 through lower panel 142, it is within the scope of the present invention to have more than or fewer than the three apertures 18 shown. Around each aperture 18 in lower panel 142 is a plurality of slits 20 cut into lower panel 142 and extending radially from aperture 18. Slits 20 create a plurality of radial tabs 22 circumscribing apertures 18. Apertures 18, slits 20 and radial tabs 22 are identical to the apertures, slits and tabs described above for the embodiment shown in FIGS. 1 through 5.

Second generally rectangular box section 116 includes an upper panel 150, a lower panel 152, a first side panel 154 and a second side panel 156. Lower panel 152 is rectangular approximately one-half the size of upper panel 112 and the same size as lower panel 142. Lower panel 152 has three apertures 18 therethrough. While the present invention is shown as having three apertures 18 through lower panel 152, it is within the scope of the present invention to have more than or fewer than the three apertures 18 shown. Around each aperture 18 in lower panel 152 is a plurality of slits 20 cut into lower panel 152 and extending radially from aperture 18. Slits 20 create a plurality of radial tabs 22 circumscribing apertures 18. Apertures 18, slits 20 and radial tabs 22 are identical to the apertures, slits and tabs described above for the embodiment shown in FIGS. 1 through 5.

First rectangular box section 114 is disposed adjacent to second rectangular box section 116 as shown in FIG. 7. Second side panel 146 of first box section 114 is fixedly secured to first side panel 154 of second box section 116 by gluing or other means known well in the art. Upper planar member 112 is disposed adjacent to both first box section 114 and second box section 116 as shown in FIG. 7 such that upper panel 140 of first box section 114 is adjacent to and fixedly secured to upper planar member 112 by gluing or other means known well in the art. Likewise, upper panel 150 of second box section 116 is adjacent to and fixedly secured to upper planar member 112 by gluing or other means known well in the art. Thus device 110 includes both a double thickness of material, (upper planar member 112, upper panel 140 and upper panel 150) as well as a vertical section (second side panel 146 and first side panel 154)

which extends lengthwise down the center of upper planar member 112 for supporting the plurality of containers. The rigidity of device 110 is maintained by the gluing of the above described panels on two planes which are disposed generally perpendicular to one another. The first plane is defined by the gluing or mating of upper planar member 112 with upper panel 140 and upper panel 150. The second plane, generally perpendicular to the first plane is defined by the gluing or mating of second side panel 146 and first side panel 154.

In the embodiment shown in FIGS. 6 and 7, device 110 is formed from a single sheet of material. After the plurality of apertures 18, slits 20 and radial tabs 22 are formed, the center of the sheet of material forms upper planar member 112. The sheet of material is folded at 160 and 162 to form first side panel 144 and second side panel 156. The sheet of material is folded again at 164 and 166 to form lower panel 142 and lower panel 152. The sheet of material is folded a third time at 168 and 170 to form second side panel 146 and first side panel 154. The sheet of material is folded a fourth and final time at 172 and 174 to form upper panel 140 and upper panel 150. Once device 110 is formed, the gluing or attaching of the various panels as described above completes the formation of device 110.

The foregoing discussion discloses and described merely exemplary embodiments of the present invention. One skilled in the art will readily recognize from such discussion, and from the accompanying drawings and claims, that various changes, modifications and variations can be made therein without departing from the spirit and scope of the invention, as defined in the following claims.

What is claimed is:

1. A container securing device comprising:

a substantially planar member;

a first rectangular hollow box section having an upper panel, a lower panel, a first side panel and a second side panel, said upper panel being fixedly secured to said planar member, said lower panel having at least one aperture means for securing a container to said device;

a second rectangular hollow box section having an upper plate, a lower plate, a first side plate and a second side plate, said upper plate being fixedly secured to said planar member, said first side plate being fixedly secured to said second side panel of said first rectangular hollow box, said lower plate defining at least one aperture means for securing a container to said device.

2. The container securing device according to claim 1 wherein said container device is formed from a single sheet of material.

3. The container securing device according to claim 1 wherein the securing of said upper panel and said upper plate to said planar member defines a first plane and the securing of said first side panel to said second side plate defines a second plane, said second plane being generally perpendicular to said first plane.

4. The container securing device according to claim 1 wherein said container securing device is constructed from cardboard.

5. The container securing device according to claim 1 wherein said container securing device is constructed from a single sheet of cardboard.

6. The container securing device according to claim 1 wherein said aperture means of said lower panel and said lower plate are circular.

7. The container securing device according to claim 1 wherein said lower panel and said lower plate further includes a plurality of slits extending radially outward from each of said aperture means to define a plurality of tabs.

8. The container securing device according to claim 1 further comprising means for gripping said container securing device.

9. The container securing device according to claim 8 wherein said means for gripping said container securing device comprises a pair of finger holes defined by said planar member, said upper panel and said upper plate.

* * * * *